United States Patent [19]

Whitlaw

[11] Patent Number: 4,591,415

[45] Date of Patent: May 27, 1986

[54] PLATING BATHS AND METHODS FOR ELECTRO-DEPOSITION OF GOLD OR GOLD ALLOYS

[75] Inventor: Keith J. Whitlaw, Buxton, England

[73] Assignee: LeaRonal, Inc., Freeport, N.Y.

[21] Appl. No.: 743,259

[22] Filed: Jun. 11, 1985

Related U.S. Application Data

[63] Continuation-in-part of Ser. No. 682,385, Dec. 17, 1984, abandoned.

[30] Foreign Application Priority Data

Dec. 22, 1983 [GB] United Kingdom ..... 8334226

[51] Int. Cl.[4] ..... C25D 3/48; C25D 3/62; C25D 5/02

[52] U.S. Cl. ..... 204/15; 204/28; 204/44.3; 204/46 G

[58] Field of Search ..... 204/44.3, 44, 47.5, 204/123, 15, 28

[56] References Cited

U.S. PATENT DOCUMENTS 3,902,977 9/1975 Greenspan ..... 204/44.3
3,929,595 12/1975 Biberbach et al. ..... 204/44

FOREIGN PATENT DOCUMENTS 216260 12/1984 German Democratic Rep. ..... 204/47.5

OTHER PUBLICATIONS

Chemical Abstracts, vol. 103, No. 13580j, "Electrolyte for Use in Electroplating Semibright Gold Alloys" (1985).

R. T. Hill et al., IEEE Trans. on Components, Hybrids, and Manufac. Technol., vol. CHMT-Z, No. 3, pp. 324-329, Sep. 1979.

*Primary Examiner*—G. L. Kaplan

*Attorney, Agent, or Firm*—Pennie & Edmonds

[57] ABSTRACT

Aqueous acid gold or gold alloy baths containing a substituted pyridine carboxylic acid, pyridine thiol, quinoline carboxylic acid, quinoline thiol, or a derivative or mixtures thereof, as an additive and methods of using such baths.

21 Claims, No Drawings

PLATING BATHS AND METHODS FOR ELECTRO-DEPOSITION OF GOLD OR GOLD ALLOYS

CROSS REFERENCE TO RELATED APPLICATIONS:

This application is a continuation-in-part of application Ser. No. 682,385, filed Dec. 17, 1984, now abandoned.

TECHNICAL FIELD

The invention relates to gold or gold alloy acid electroplating baths and to methods of using of such baths for electrodeposition of pure gold or gold alloys.

BACKGROUND ART

It is known in the art to use compounds of the amine type as normal additives for increasing the maximum permissible current density of acid gold electroplating baths. These additives are either polyamines, e.g. tetraethylene pentamine, or polyimines, e.g. polyethylene imines, of various molecular weights. It has been observed, however, that the incorporation of these substances into gold or gold alloy plating bath formulations causes instability of the solution and variability of the resulting deposits.

While the above mentioned additives are effective in increasing the bright plating range, they do have the undesirable side effect of reducing the cathode efficiency by a substantial amount so that the effective deposition rate is not improved, even though the plating range is extended. Thus, these additives have little or no value for high speed plating.

Accordingly, it is an object of the present invention to provide an acid gold electroplating bath of an improved formulation which allows an increase of the maximum permissible current density without significant loss in cathode efficiency, thereby giving increased deposition rates which in turn enables higher production rates.

Other objects and advantages will be apparent to those skilled in the art from the following detailed description of the invention.

SUMMARY OF THE INVENTION

The present invention relates to the electro-deposition of pure gold or gold alloys containing conventional gold alloying metals such as nickel, cobalt, and iron as well as other metals commonly used for alloying gold. The gold or alloys are electro-deposited from aqueous acid gold or gold alloy baths that contain at least one bath soluble substituted pyridine or quinoline compound or mixtures thereof. The exact gold alloy to be formulated will of course depend upon the intended use for the end deposit.

The invention includes aqueous acid gold or gold alloying baths containing one or more bath soluble substituted pyridine or quinoline compounds or mixtures thereof. The basic aqueous acid gold or gold alloy baths to which the bath soluble substituted pyridine or quinoline compounds can be added may be virtually any standard or basic prior art bath for the electrodeposition of gold alloys.

The invention further includes methods for the electro-deposition of gold or gold alloys as well as uses for the acid baths prepared according to the invention. Use examples would include plating of printed circuit board edge tabs and connector applications as well as high speed reel to reel plating applications.

The applicant has discovered that bath soluble substituted pyridine or quinoline compounds are capable of increasing the deposition rate of virtually any acid gold or gold alloy plating bath by increasing the current density range without appreciably affecting the cathode efficiency. The degree of current density increase that is effectuated by use of these compounds is approximately 25–100%, while the amount of the current efficiency decrease is only slightly affected. Also, the increase in deposition rate ranges from about 25 to 100% or more.

Another advantage of the use of these bath soluble substituted pyridine or quinoline compounds is that there is little or no impairment of any of the deposit characteristics such as brightness, hardness, ductility, porosity, solderability, contact resistance, corrosion resistance, and the like.

In general, any bath soluble substituted pyridine or quinoline compound is capable of giving the desired result. Preferably, these compounds or additives are mono- or dicarboxylic acid, mono- or dithiol substituted pyridines, quinolines, pyridine derivatives, or quinoline derivatives. The pyridine or quinoline derivatives may be substituted in one or more positions and can contain mixed subsituents.

The most advantageous pyridine derivatives found to date are those substituted in the 3-position of the pyridine ring. Examples of such pyridine derivatives include pyridine carboxylic acids and pyridine thiols. The pyridine carboxylic acids are preferably used as esters or amides, the latter being optionally substituted in its $NH_2$ group with a lower alkyl group of 1–4 carbon atoms, e.g. a methyl, ethyl, propyl or butyl group.

Especially preferred additives are nicotinic acid, i.e. pyridine-3-carboxylic acid, quinoline-3-carboxylic acid, 2- or 4-pyridine carboxylic acids, nicotinic acid methyl ester, nicotinamide, nicotinic acid diethyl amide, pyridine-2, 3-dicarboxylic acid, pyridine-3,4-dicarboxylic acid, and pyridine-4-thioacetic acid.

When a pyridine thiol derivative is used, the thiol group may be substituted with a group or, an organic acid, or a carboxyl group such as, for example, formic acid, acetic acid, or propionic acid.

Especially advantageous is the use of nicotinic acid or nicotinamide.

When the additive is an ester derivative of pyridine or quinoline, the ester group is advantageously a lower alkyl group, preferably having 1 to 3 carbon atoms, because these compounds are soluble in a wide range of plating baths.

The concentration of the additives used to achieve the desired results depends upon the particular substituted pyridine or quinoline compound used. Large excesses of any compound should be avoided since the excess concentration may cause reduced cathode efficiencies and deposition rates. An insufficient amount of the additive will result in a negligible improvement of the deposition rate. The proper concentration of additive to be used with any given electrolyte or plating bath in order to achieve the desired results can readily be determined with laboratory tests known to those skilled in the plating art.

Generally, the optimum concentration for any compound is the minimum required to give the maximum increase in deposition rate without adversely affecting deposit characteristics. Nicotinic acid has been found to be effective in a concentration between about 2 and 9 g/l and most effective at about 4.5 g/l. Pyridine-4-thio acetic acid is effective in a concentration between about 0.3 and 2 g/l, and is most effective at about 1 g/l. Other specific compounds and baths will require slightly different concentration ranges for optimum results.

These additives can be mixed into any conventional or basic prior art plating bath, and these usually include the aqueous cyanide or non-cyanide types. Generally, the bath comprises a soluble source of gold, such as gold cyanide or a gold sulphite, an electrolyte selected from the phosphates, citrates, sulphites, phosphonates, malates, tartrates or a combination of these, and optionally, an additive which is generally selected from polyamino acetic acids, carboxymethylated derivatives of organic phosphonic acids, or chelate forming substances.

The plating bath may also include an organic or inorganic acid, such as phosphoric, phosphonic, phosphinic, citric, malic, formic, or polyethylene amino acetic acid, in conjunction with a brightening or grain refining agent, which agent generally comprises a base metal salt compound or chelate, such as cobalt or nickel sulphate, or a chelate of a base metal. Some examples of such prior art baths are described in U.S. Pat. Nos. 2,905,601, 3,672,969 and 3,898,137.

The pH of the plating bath may vary over a wide, acidic pH range, the preferred pH range being between about 3 and 5. The pH may be adjusted to this range by the addition of an alkali metal hydroxide, such as for instance potassium or sodium hydroxide, or by an acid, preferably phosphoric acid.

Gold alloy electrodeposits may be obtained by incorporating the determined alloying metals, such as nickel, cobalt, iron, silver, cadmium, indium or mixtures thereof, into the gold electroplating bath. Such metals may be added to the plating bath as soluble metal salts or in the form of chelates, e.g. nickel sulphate, nickel tartrate, cobalt sulphate or cobalt gluconate.

The invention also comprises a method for electrodeposition of gold or gold alloys using the acidic bath compositions as described herein. The method according to the invention provides a substantial increase of the maximum current density. Electrodeposition can be carried out according to the invention at current densities between about 25 and 100 amps/dm$^2$ (230 to 920 ASF). In spite of this increase of maximum permissible current density, the process does not have the drawback of a significant loss in cathode efficiency as does prior art baths.

The following examples show the advantageous effects of the addition of a substituted pyridine compound or derivative according to the present invention. The scope of the invention is further described in connection with the following examples which are set forth for purposes of illustration only and are not to be construed as limiting the scope of the invention in any manner.

EXAMPLE 1

A commercial, hard, nickel gold alloy plating was prepared as follows:

| | |
|---|---|
| gold as $KAu(CN)_2$ | 10 g/l |
| nickel as chelate | 0.8 g/l |
| citric acid | 100 g/l |
| oxalic acid | 20 g/l |
| Dequest 2000 | 20 ml/l |
| pH (adjusted with KOH) | 4.2 |
| density | 1.15 |
| temperature | 50° C. |

This aqueous solution was prepared in a one liter beaker fitted with platinized titanium anodes and stirred by means of a magnetic stirrer. Cathode efficiency tests were carried out by plating 5 cm×2.5 cm brass panels in conjunction with a copper coulometer. The results are shown below in Table I.

TABLE I

| Bath Without Nicotinic Acid | | |
|---|---|---|
| Current Density | Deposit Appearance | Cathode Efficiency |
| 2 amps/dm$^2$ | bright deposit | 53% |
| 4 amps/dm$^2$ | slight burning | 42% |
| 6 amps/dm$^2$ | increased burning | 27% |

EXAMPLE 2

Example 1 was repeated after the addition of 4.5 g/l nicotinic acid (BP grade dissolved in water and neutralized with potassium hydroxide before addition) to the solution of Example 1, with the results shown below in Table II.

TABLE II

| Bath with 4.5 g/l Nicotinic Acid | | |
|---|---|---|
| Current Density | Deposit Appearance | Cathode Efficiency |
| 2 amps/dm$^2$ | bright deposit | 52% |
| 4 amps/dm$^2$ | bright deposit | 37% |
| 6 amps/dm$^2$ | bright deposit | 27% |

EXAMPLE 3

A further series of experiments was carried out using the S.G. Owen Mini-Lab, which is a laboratory unit designed to simulate production conditions with high speed jet agitation. Again the solution and conditions of Example 1 were modified as follows:

| | |
|---|---|
| gold | 12 g/l |
| nickel | 0.75 g/l |
| pH | 4.35 |
| density | 1.11 |
| temperature | 60° C. |

The results are outlined in Tables III and IV:

TABLE III

| Bath without Nicotinic Acid | | | |
|---|---|---|---|
| Current Density | Deposit Appearance | Cathode Efficiency* | Plating rate for 1 micron |
| 25 amps/dm$^2$ | bright deposit | 71.7 | 5.7 secs. |
| 50 amps/dm$^2$ | severe burning | 54.8 | 3.7 secs. |
| 75 amps/dm$^2$ | severe burning | 42.4 | 2.9 secs. |
| 100 amps/dm$^2$ | severe burning | 38.2 | 2.7 secs. |

*expressed in mg/amp. mins.

TABLE IV

| Bath with 4.5 g/l Nicotinic Acid | | | |
|---|---|---|---|
| Current Density | Deposit Appearance | Cathode Efficiency* | Plating rate for 1 micron |
| 25 amps/dm$^2$ | bright deposit | 69.8 | 6.0 secs. |
| 50 amps/dm$^2$ | bright deposit | 54.8 | 3.7 secs. |
| 75 amps/dm$^2$ | very slight | 41.0 | 3.3 secs. |
| 100 amps/dm$^2$ | slight burning | 32.9 | 3.1 secs. |

*expressed in mg/amp. mins.

As can be seen from the results the minimum time to deposit one micron in bright condition without nicotinic acid is approximately 5.7 seconds. The addition of nicotinic acid reduces this minimum time to about 3.7 seconds.

EXAMPLE 4

A gold plating was prepared as follows:

| | |
|---|---|
| gold as $KAu(CN)_2$ | 8 g/l |
| Dequest 2000 | 200 ml/l |
| Dequest 2010 | 30 ml/l |
| Water to make one liter | |
| pH (adjusted with KOH) | 3.8 |

Cathode efficiency tests were then carried out for this solution by utilizing a Hull Cell at 110 F for 5 minutes at 1 Amp using reciprocating agitation. The results are shown below in Table V.

TABLE V

| | Bath without Nicotinic Acid | |
|---|---|---|
| Current Density | Deposit Appearance | Cathode Efficiency |
| 2 ASF | bright deposit | 76% |
| 25 ASF | burnt | 44% |

EXAMPLE 5

5 g/l of nicotinic acid was added to the bath of Example 5. The Hull Cell test was repeated for this solution with the results shown below in Table VI.

TABLE VI

| | Bath with Nicotinic Acid | |
|---|---|---|
| Current Density | Deposit Appearance | Cathode Efficiency |
| 2 ASF | Bright deposit | 83% |
| 25 ASF | bright deposit | 35% |

Dequest 2000 referred to in the examples is a chelating agent of the formula $N(CH_2H_2PO_3)_3$ or nitrilo tri-(methyl phosphonic acid), and has been found to be particularly advantageous. Any chelating agent, however, can be used in this process.

Dequest 2010 is 1-hydroxy ethylidene 1, 1-diphosphonic acid compound. Also, salts of this compound can be used. Other ingredients such as citric or oxalic acid can be used in pure acid gold plating baths as can be used with the gold alloy plating baths as described previously.

Cathode efficiency in the above examples is expressed on percentage, 100% equals 122 mg/amps-minute and the plating rate is time in seconds to deposit one micron assuming a deposit density of 17.0 g/cc.

The advantages obtained with the present invention are of particular importance for connector applications, since an increased manufacturing output is obtained. Connector components are often plated by a reel-to-reel technique and the speed of production is proportional to the speed of plating in the acid gold bath.

Another area where the present invention has a special advantage is that of gold or gold alloy plating of printed circuit board edge tabs, where the addition of substituted pyridine or quinoline compounds according to the invention allows operating speeds to be maintained with lower gold concentrations, thereby giving gold savings in reduced dragout losses and reduced inventory.

The use of the additives according to the invention in this system also improves metal distribution, since it allows operation at higher current densities where the rate of change of cathode efficiency with current density is at its maximum. In the new type of printed circuit board plating machines, socalled linear "tab" plating equipment, such an increased speeds of deposition are of significant importance.

While it is apparent that the invention hereindisclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention.

I claim:

1. An aqueous acid gold electroplating bath for electrodeposition of pure gold or gold alloys comprising a soluble source of gold, at least one bath soluble pyridine carboxylic acid, pyridine thiol, quinoline carboxylic acid, quinoline thiol, or derivatives or mixtures thereof, and, optionally, at least one soluble gold alloying metal.

2. The bath according to claim 1 wherein the pyridine compound is a mono- or dicarboxylic acid or a mono- or dithiol derivative of pyridine.

3. The bath according to claim 1 wherein said pyridine compound is substituted in the 3-position of the pyridine ring.

4. The bath according to claim 1 wherein said pyridine compound is an amide or ester of a pyridine carboxylic acid.

5. The bath according to claim 1 wherein the thiol group of said pyridine thiol is substituted by a carboxyl group.

6. The bath according to claim 1 in which the pyridine or quinoline compound is nicotinic acid, quinoline-3-carboxylic acid, 2- or 4-pyridine carboxylic acid, nicotinic acid methyl ester, nicotinamide, nicotinic acid diethyl amide, pyridine-2,3-dicarboxylic acid, pyridine 3,4-dicarboxylic acid, pyridine-4-thioacetic acid, or mixtures thereof.

7. A method for electroplating pure gold or gold alloys to form a bright, hard deposit, which comprises immersing a substrate to be plated into an aqueous acidic gold or gold alloy bath comprising a soluble source of gold, at least one bath soluble pyridine carboxylic acid, pyridine thiol, quinoline carboxylic acid, quinoline thiol, or derivatives or mixtures thereof, and, optionally, at least one soluble gold alloying metal, and electroplating a pure gold or gold alloy upon said substrate.

8. The method according to claim 7 wherein the pyridine or quinoline compound is nicotinic acid, quinoline-3-carboxylic acid, 2- or 4- pyridine carboxylic acid, nicotinic acid methyl ester, nicotinamide, nicotinic acid diethyl amide, pyridine-2,3-dicarboxylic acid, pyridine 3,4-dicarboxylic acid, pyridine 4-4-thioacetic acid or mixtures thereof.

9. The method according to claim 7 wherein the plating process is carried out at a current density from 5 to 100 amps/$dm_2$.

10. A method for increasing the deposition rate of gold or gold alloys from an aqueous acidic gold or gold alloy bath which comprises adding a sufficient amount of at least one bath soluble pyridine carboxylic acid, pyridine thiol, quinoline carboxylic acid, quinoline thiol, or a derivative or mixtures thereof, to an aqueous acidic gold or gold alloy bath comprising a soluble source of gold and, optionally, at least one soluble gold alloying metal.

11. The method according to claim 10 wherein the pyridine or quinoline compound is nicotinic acid, quinoline-3-carboxylic acid, 2- or 4- pyridine carboxylic acid, nicotinic acid methyl ester, nicotinamide, nicotinic acid diethyl amide, pyridine-2,3-dicarboxylic acid, pyridine 3,4-dicarboxylic acid, pyridine 4-4-thioacetic acid, or mixtures thereof.

12. A method for increasing the maximum plating rate of an aqueous acid gold electroplating bath without reducing the cathode efficiency which comprises adding at least one bath soluble pyridine carboxylic acid, pyridine thiol, quinoline carboxylic acid, quinoline thiol, or derivatives or mixtures thereof, to an aqueous acid gold bath comprising a soluble source of gold.

13. A method for increasing the maximum plating rate of an aqueous acid gold alloy electroplating bath which comprises adding a bath soluble pyridine carboxylic acid, pyridine thiol, quinoline carboxylic acid, quinoline thiol, or derivatives or mixtures thereof, to an aqueous acid gold alloy bath comprising a soluble source of gold and at least one soluble gold alloying metal.

14. A method for plating electrical components which comprises immersing the portions of the component to be plated in an aqueous acid gold plating bath, and electroplating gold thereon at a current density of from 5 to 100 amps/dm$^2$, said aqueous acid gold plating bath comprising a soluble source of gold, an electrolyte, and at least one bath soluble pyridine carboxylic acid, pyridine thiol, quinoline carboxylic acid, quinoline thiol, or derivatives or mixtures thereof, to increase the maximum current density.

15. The method according to claim 14 wherein the electrical component is a printed circuit board tab.

16. A method for plating electrical components which comprises immersing the portions of the components to be plated in an aqueous acid gold plating bath, and electroplating a gold alloy thereon at a current density of from 5 to 100 amps/dm$^2$, said aqueous acid gold plating bath comprising a soluble source of gold, at least one soluble gold alloying metal, and a bath soluble pyridine carboxylic acid, pyridine thiol, quinoline carboxylic acid, quinoline thiol, or derivatives or mixtures thereof, to increase the maximum current density.

17. The method according to claim 16 wherein the electrical component is a printed circuit board tab.

18. A method for high speed reel-to-reel plating of electrical components which comprises immersing the portions of the component to be plated in an acidic gold plating bath, and electroplating gold thereon at a current density of from 5 to 100 amps/dm$^2$, said acidic gold plating bath comprising a soluble source of gold, and at least one bath soluble pyridine carboxylic acid, pyridine thiol, quinoline carboxylic acid, quinoline thiol, or derivatives or mixtures thereof, to increase the maximum current density.

19. The method according to claim 18 wherein the electrical component is a printed circuit board tab.

20. A method for high speed reel-to-reel plating of electrical components which comprises immersing the portions of the component to be plated in an acidic gold plating bath, and electroplating a gold alloy thereon at a current density of from 5 to 100 amps/dm$^2$, said acidic gold plating bath comprising a soluble source of gold, at least one soluble gold alloying metal, and at least one bath soluble pyridine carboxylic acid, pyridine thiol, quinoline carboxylic acid, quinoline thiol, or a derivative or mixtures thereof, to increase the maximum current density.

21. The method according to claim 19 wherein the electrical component is a printed circuit board tab.

* * * * *